US006087307A

United States Patent [19]

Kaminski et al.

[11] Patent Number: 6,087,307

[45] Date of Patent: Jul. 11, 2000

[54] POLYETHER FLUIDS MISCIBLE WITH NON-POLAR HYDROCARBON LUBRICANTS

[75] Inventors: Joan M. Kaminski, Mullica Hill; Richard N. Nipe, Cherry Hill; Liwen Wei, Martinsville; Margaret May-Som Wu, Skillman, all of N.J.

[73] Assignee: Mobil Oil Corporation, Fairfax, Va.

[21] Appl. No.: 09/192,996

[22] Filed: Nov. 17, 1998

[51] Int. Cl.[7] ..... C10M 107/02; C10M 145/26

[52] U.S. Cl. ..... 508/223; 508/579

[58] Field of Search ..... 508/223, 579

[56] References Cited

U.S. PATENT DOCUMENTS

| | | | |
|---|---|---|---|
| 3,454,652 | 7/1969 | Dunlop et al. | 568/617 |
| 4,129,717 | 12/1978 | Praetorius et al. | 508/223 |
| 4,481,123 | 11/1984 | Hentschel et al. | 568/617 |
| 5,416,240 | 5/1995 | Weyer et al. | 568/617 |

FOREIGN PATENT DOCUMENTS

J58083028 11/1981 Japan .

*Primary Examiner*—Jacqueline V. Howard
*Assistant Examiner*—Cephia D. Toomer

[57] ABSTRACT

Homogeneous lubricant blends are disclosed comprising polyether liquid lubricants miscible with synthetic hydrocarbon fluids or severely hydroprocessed basestock. The lubricants comprise SHF or hydroprocessed basestock and polyalkylene oxide polymer having recurring units of at least one long chain monoepoxy alkane monomer(s) containing 8 to 30 carbon atoms and short chain comonomer(s) selected from the group consisting of substituted or unsubstituted tetrahydrofuran, oxetan, butylene oxide propylene oxide and ethylene oxide wherein the mole ratio of long chain monoepoxy alkane monomers to short chain comonomers is between 0.5 and 9.

7 Claims, 2 Drawing Sheets

POLYETHER FLUIDS MISCIBLE WITH NON-POLAR HYDROCARBON LUBRICANTS

FIELD OF THE INVENTION

This invention relates to the production of polyether liquid lubricants prepared by cationic polymerization or copolymerization of long chain epoxides with oxiranes using, preferably, heteropolyacid catalysts. The invention particularly relates to the production of novel polyether liquid lubricants that are compatible and. miscible with hydrocarbon-based fluids such as synthetic hydrocarbon fluids (SHF's) and some severely hydroprocessed basestocks. The invention especially relates to copolymer polyethers blended with synthetic hydrocarbon fluids such as polyalphaolefins (PAO) and/or some severely hydroprocessed basestock liquid lubricants wherein the polyethers are prepared from tetrahydrofuran and long chain epoxide comonomers that are useful as blend stocks or additives for non-polar hydrocarbon fluids.

BACKGROUND OF THE INVENTION

The use of polyether fluids is well known in applications such as hydraulic fluids, brake fluids, cutting oils and motor oils where the synthetic ability to structure properties such as water miscibility, fire resistance, lubricant properties and extreme pressure resistance provides a competitive advantage over other fluids. The polyether oils in practical use comprise polyalkylene glycols and their end-capped monoethers, diethers, monoesters and diesters. They include polyalkylene oxide polyether homopolymer, copolymer and block copolymer and can be prepared principally by the anionic polymerization or copolymerization of oxiranes or epoxides. Small or large molecule end-capping groups are added in the polymerization to modify the properties of the resultant polyether as appropriate for the selected application.

Basic catalysts are generally employed in the art for the production of polyethers from cyclic ethers such as oxiranes because anionic catalysis produces a product with a substantially smaller or narrower molecular weight distribution than the product produced by cationic polymerization using conventional Lewis acids. Lewis acids are intrinsically of higher activity leading to extensive chain transfer and cyclic formation reactions. Also, effective acid catalysts for cyclic ether polymerization or copolymerization including liquid super acids such as fuming sulfuric acid, fluorosulfonic acid or $BF_3$/promoter catalysts are difficult to handle and are more troublesome to dispose of in an environmentally acceptable manner.

These activity and environmental issues are of great concern for the production of tetrahydrofuran-containing polyethers which employ acid catalysts. Substantial efforts in the prior art have been devoted to resolving these issues by preventing cyclic formations and by employing solid acid catalysts.

U.S. Pat. No. 4,568,775 describes a two phase process for the polymerization of tetrahydrofuran or a mixture of tetrahydrofuran and other cyclic ethers in contact with a heteropolyacid catalyst having 0.1 to 15 mol of water per mol of heteropolyacid catalyst present in the catalyst phase. The polyether glycols prepared from the process are useful as starting material for the production of urethane. The process uses large volumes of catalyst in the two phase process.

U.S. Pat. No. 4,988,797 polymerizes oxetan and tetrahydrofuran (THF) in the presence of excess alcohol in contact with acid catalyst wherein the molar ratio of acid catalyst to hydroxyl groups is between 0.05:1 and 0.5:1. The invention is particularly directed to the polymerization of oxetanes.

U.S. Pat. No. 5,180,856 teaches the polymerization of THF and glycidyl ether in the presence of alkanol to produce polyethers. Lewis acid catalyst such as boron trifluoride is used. The polymerization is carried out in the presence of 0.01–5 weight percent of Lewis acid catalyst. The products are useful as lubricants. The Lewis acid catalysts that are dissolved in the polyether-products have to be separated, destroyed and discarded as wastes.

U.S. Pat. No. 4,481,123 teaches the production of polyethers from THF and alpha alkylene oxides having an alkyl radical containing 8–24 carbon atoms. The polymerization is carried out in contact with Lewis acid catalyst. The polymerization can further include $C_1$–$C_4$ epoxide and alcohol. The polyether products are useful as lubricants.

In view of the excellent lubricant properties of polyethers and the known advantages of many non-polar hydrocarbon fluids, including synthetic hydrocarbon fluids (SHF's), and particularly polyalpha-olefins (PAO) or severely hydroprocessed basestocks of 3–100 cSt viscosity at 100° C., one is compelled to consider blends of these components to form lubricants with enhanced performance capabilities. Polyether blends with mineral oil lubricants are known and useful in the art. However, attempts to form such blends with non-polar basestocks has been frustrated by the poor solubility of polyethers in SHF's.

High molecular weight or high viscosity SHF's such as 40 or 100 cSt PAO are highly hydrophobic. Because of this hydrophobicity they are poor solubilizers for many polar or slightly polar lubricant base stocks and additives. It is not obvious to one skilled in the art how to determine the solubility trends for such highly hydrophobic fluids toward polar organic molecules. For instance, dicarboxylic esters were used as blend stocks for 40 or 100 cSt PAO; but other esters such as polyol esters with similar hydrocarbon compositions were immiscible.

Recently, severely hydrotreated basestocks have become available to the lubricant formulator. Severely hydrotreated base stocks are described in the article "Base Stocks: The Real Story" by D. E. Deckman et al in Hart's Lubricant World, pp 46–50, July 1997, which article is incorporated herein by reference. These base stocks, typically produced by hydrocracking distillate or wax, have improved oxidation stability and very low olefins and aromatics content. However, due to the severity of the hydroprocessing of the feedstock the resulting base stocks are very paraffinic and have poor or decreased solubility and compatibility with polar fluids such as polyalkylene glycols. In order to take advantage of the performance features of both the polyethers and the severely hydroprocessed base stocks polyethers are required that have increased solubility and compatibility with severely hydrotreated basestocks.

It is also well known in the literature of lubricant arts that the chemical compositions of conventional mineral oil produced from solvent refining are very different from SHF such as polyalphaolefins or severely cracked base stocks. These compositional differences are responsible for many of their property differences such as their solubility with additives or polar cobasestocks, oxidative stability, etc. However, the different compositions of SHF and severely hydrotreated base stock compromise their ability to solubilize polyether additives and so, absent the discoveries of the instant invention, have denied to the lubricant formulator the use of the performance advantages that can accrue to a SHF or severely hydrotreated base stock that incorporate polyethers as additive or cobasestock.

U.S. Pat. No. 4,481,123 teaches new polyethers obtainable by polymerization of 1,2-epoxyalkane with 8 to 26 carbon atoms and a tetrahydrofuran in the presence of a hydroxy compound. The polymerization is catalyzed by conventional Lewis acid catalysis to produce lubricants that are miscible with mineral oil. This result is not unexpected for conventional mineral oils are usually much more polar than synthetic hydrocarbon fluids such as PAO and more polar than severely hydroprocessed basestock. Conventional mineral oils typically contain 5–10% polar aromatic components and higher amounts of cyclic naphthenic components. As SHF's or severely hydroprocessed basestocks are essentially absent of these solubilizing components, their miscibility and compatibility with polyethers is restricted. Notably, the patent does not teach or claim that the new polyethers are, in fact, miscible with high viscosity SHF's; nor does the patent teach polymerization of polyethers by heteropolyacid catalysis.

It is an object of the present invention to provide polyether lubricants and a method for their preparation wherein the polyether lubricants are miscible with the relatively non-polar synthetic hydrocarbons, especially PAO and severely hydroprocessed basestock.

It is a further object of the present invention to provide blends of polyether lubricants and high viscosity PAO wherein the blends exhibit low pour point, high viscosity index (VI), superior antiwear properties, plus low friction coefficients.

SUMMARY OF THE INVENTION

A method has been discovered to prepare homogeneous blends of severely hydroprocessed basestock and/or synthetic hydrocarbon fluids such as PAO with polyalkylene oxides or polyethers. It has been discovered that long chain epoxides, when polymerized into polyalkylene oxides are soluble in SHF or severely hydroprocessed fluids essentially in all proportions and lead to the formation of polyether/SHF or severely hydroprocessed basestock blends that exhibit outstanding liquid lubricant properties. The term long chain epoxides (LCE) as used herein refers to monoepoxides containing 8 to 30 carbon atoms as typified by 1,2-epoxyalkanes. The epoxy group of LCE may be in the terminal position or internal epoxy alkanes can be used where both carbon atoms of the epoxy group carry alkyl substituents. Preferably, 1,2-epoxyalkanes are used to prepare a copolymer with tetrahydrofuran.

The polyether liquid lubricants that are miscible with the non-polar synthetic hydrocarbon basestock or severely hydroprocessed basestock comprise polyalkylene oxide polymer having recurring units of at least one long chain monoepoxy alkane monomer(s) containing 8 to 30 carbon atoms. The LCE monomers may be used alone or preferably in combination with one or more short chain comonomer(s), selected from the group consisting of $C_1$–$C_4$ alkyl substituted or unsubstituted tetrahydropyran, tetrahydrofuran, oxetan, propylene oxide and ethylene oxide. The resultant polyalkylene oxides have the structure

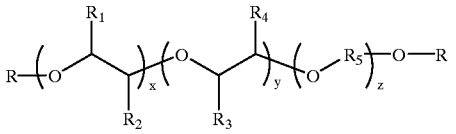

wherein R is hydrogen, alkyl, aryl or carbonyl; $R_1$ is hydrogen or $C_1$–$C_{27}$ alkyl and $R_2$ is $C_1$–$C_{28}$ alkyl with at least one of $R_1$ or $R_2$ having between 6 and 27 carbon atoms; $R_3$ and/or $R_4$ are hydrogen or methyl; $R_5$ is $C_1$–$C_4$ alkyl substituted or unsubstituted linear polymethylene including trimethylene, tetramethylene or pentamethylene; wherein x is an integer from 1 to 50, y and z are integers from 0 to 50 and recurring units of x are alike or different.

The polyalkylene oxides of the invention are prepared by Lewis acid catalysis of the selected monomers or comonomers. The preferred catalyst is heteropolyacid catalyst.

Very effective liquid lubricant homogeneous blends may be prepared by mixing polyalphaolefins having a viscosity between 20 and 1000 cSt at 100° C. and the polyalkylene oxide polymer prepared from monoepoxy alkanes comprising, preferably, one or more $C_8$–$C_{14}$ monoepoxy alkanes.

DETAILED DESCRIPTION OF THE INVENTION

Figure 1:
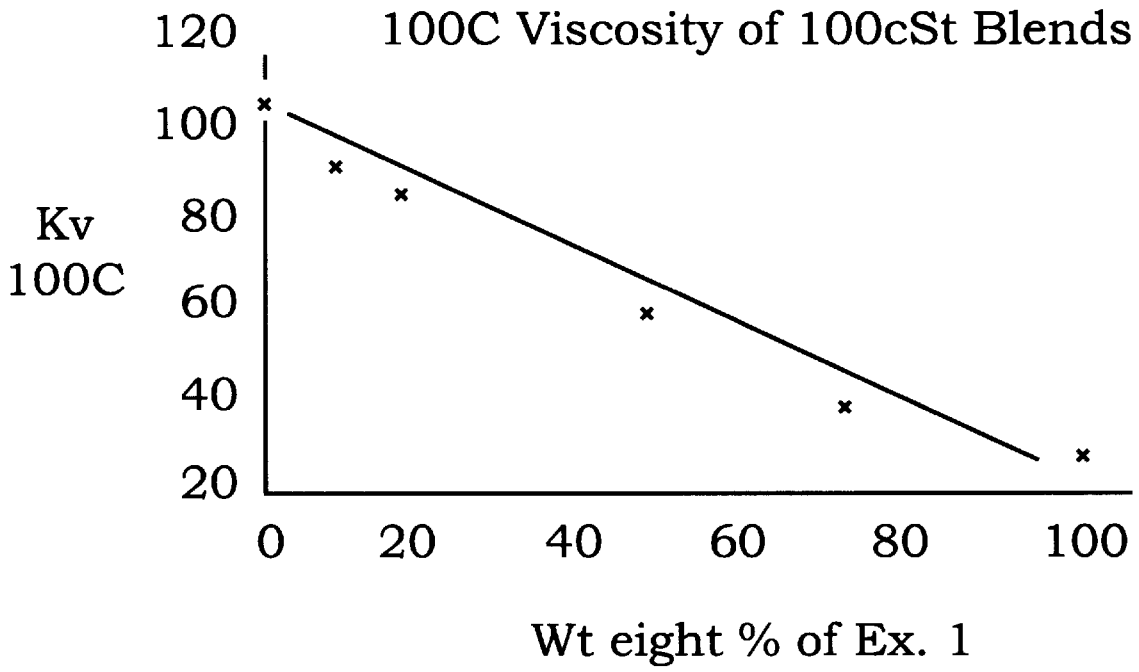
FIG. 1 is a graft plotting the viscosity of PAO blends containing various percentages of polyether of the invention.

This invention discloses the use of long chain epoxide polyethers as blend stocks or additives for non-polar SHF's or severely hydroprocessed basestock. The preferred polyethers are copolymers of one or more long chain epoxide and tetrahydrofuran.

As employed herein the terms polar, polarity and variations thereof refer to the electrostatic properties of uncharged molecules as commonly expressed by the dipole moment of the molecule.

The polyethers or, more specifically, polyalkyleneoxides of the invention found to be soluble in SHF in all proportions have the following general structure:

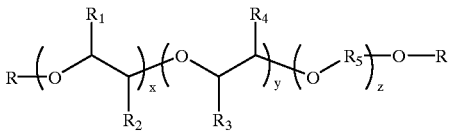

wherein R is hydrogen, alkyl, aryl or carbonyl; $R_1$ is hydrogen or $C_1$–$C_{27}$ alkyl and $R_2$ is $C_1$–$C_{28}$ alkyl; $R_3$ and/or $R_4$ are hydrogen or methyl; $R_5$ is $C_1$–$C_4$ alkyl substituted or unsubstituted linear polymethylene. The polymethylene includes trimethylene, alkyl substituted or unsubstituted tetramethylene, or pentamethylene; x is an integer from 1 to 50, y and z are integers from 0 to 50 and recurring units of x are alike or different. The preferred $R_5$ group is tetramethylene. The polyalkylene oxide may be prepared as a homopolymer of a long chain epoxide, a copolymer of two or more long chain epoxides, or a copolymer of one or more long chain epoxides with one or more of ethylene oxide, propylene oxide, or cyclic ethers such as alkyl substituted or unsubstituted THF, oxetan or tetrahydropyran. Preferably, the polyalkylene oxides of the invention comprise copolymers containing recurring units of two or more, preferably three long chain epoxides that serve to induce SHF solubility plus recurring units of low carbon number cyclic ethers comonomers that produce a linear or near linear, i.e., unbranched, methylene portion of the copolymer chain.

The solubility of polyalkylene oxides of the invention in non-polar SHF or non-polar severely hydroprocessed basestocks is strongly influenced by two key factors, i.e. the mole ratio of LCE's to the low carbon number cyclic ether comonomers in the polyalkylene oxide and the viscosity of the polyalkylene oxide copolymer. High mole ratios induce solubility in SHF as does lower polyalkylene oxide viscosity.

The monomers corresponding to the recurring units depicted in the foregoing structure of the polyalkylene oxides of the invention have the following structures:

(I)

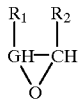

(II)

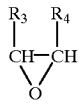

(III)

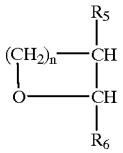

wherein (I) depicts long chain monoepoxides containing 8–30 carbon atoms where $R_1$ is hydrogen or alkyl and $R_2$ is alkyl; (II) depicts short chain monoepoxides such as ethylene oxide and propylene oxide where $R_3$ is hydrogen and $R_4$ is hydrogen or methyl; and (III) depicts cyclic ethers where n is an integer of 1–3 and $R_5$ and $R_6$, alike or different, are hydrogen or alkyl, wherein alkyl is preferably $C_1$–$C_4$ alkyl such as methyl, ethyl, propyl and butyl. (III) particularly includes oxetan, tetrahydrofuran and tetrahydropyran, most preferably tetrahydrofuran.

In the polyalkylene oxide polymer blending stock of the invention the mole ratio of long chain epoxide recurring units to short chain monoepoxides and/or cyclic ether recurring units is between 0.5 and 9, preferably between 1 and 3, where the long chain epoxide recurring units may be alike or different and contain 8–30 carbon atoms. The product polymers or copolymers have a viscosity of 5–200 cSt at 100° C.

The preferred long chain epoxides useful in the preparation of SHF soluble polyalkyleneoxides are $C_8$–$C_{14}$ monoepoxy alkanes. Particularly preferred monoepoxy alkanes are epoxyoctane, epoxydecane, epoxydodecane and epoxytetradecane which are preferably employed in equimolar ratios as a comonomer mixture in combination with THF.

The polymerization process of the invention is carried out by contacting the long chain epoxide or mixture of long chain epoxides with Lewis acid catalyst either alone or in combination with one or more cyclic ether and/or $C_2$–$C_3$ epoxide. Optionally, a chain terminating or end-capping group can be added to the reaction mixture to control polymer molecular weight or augment preferred properties of the lubricant. Examples of reagents used to control the polymerization include alcohols, acids, anhydrides, amines, etc. The polymerization reaction can be carried out at temperatures between −10° C. and 80° C. but preferably between 0° C. and 40° C. The preferred catalyst is a heteropolyacid catalyst.

Heteropolyacid catalysts useful in the present invention are described in "Metal Oxide Chemistry in Solution: The Early Transition Metal Polyoxoanions" by V. W. Day and W. G. Klemperer in Science, Vol. 228, Number 4699, May 3, 1985. The heteropolyacid catalysts comprise mixed metal oxide heteropolyacids having the formula $H_xM_yO_z$ wherein H is hydrogen, M is metal selected from Group IA, IIA, IVA, IVB, VA, VB, VIA or VIB of the Periodic Table of the Elements, O is oxygen, x is an integer from 1 to 7, y is an integer from of at least 1 and z is an integer from 1 to 60; wherein a mole of said catalyst contains between 0 and 30 moles of water of hydration. Preferred catalysts are those where M comprises at least one of molybdenum, tungsten or vanadium. Particularly preferred catalysts comprises heteropolytungstic acid having the formula $H_4PW_{21}O_{40}$, $H_4SiW_{12}O_{40}$, $H_3PMo_{12}O_{40}$ and $H_4PMo_{12}O_{40}$. The most preferred catalyst has the formula $H_3PW_{12}O_{40}$. Usually, these acids are available in hydrate form as, for example, $H_3PW_{12}O_{40}.x\ H_2O$. In order to fully activate the catalyst it is usually dried slightly to give 5–20 hydrates. Other heteropoly-acids representative of those useful in the invention include:

12-molybdophosphoric acid, 5-molybdo-2-phosphoric acid, 12-tungstophosphoric acid, 12-molybdotungstophosphoric acid, 6-molybdo-6-tungstophosphoric acid12-molybdovanadophosphoric acid, 12-molybdosilicic acid, 12-molybdotungstoboric acid, 9-molybdonickelic acid, 6-tungstocobaltic acid, 12-tungstogermanic acid, and the like.

The following non-limiting Examples are provided to illustrate the formation of the novel polymers of the invention and their utility as blend components with SHF such as PAO.

EXAMPLE 1

To a flask containing 2 gms of heteropolyacid catalyst ($H_3PW_{12}O_40.5H_2O$, dried in vacuum) and 4 gms of 1-butanol was added a solution of tetrahydrofuran (72 gms) and 1,2-epoxyalkanes (216 gms of epoxydecane, epoxydodecane, and epoxytetradecane in 1:1:1: weight ratio). During this time an exothermic reaction raised the temperature to 40° C. which was maintained by cooling with an ice bath. When addition was completed the mixture was quenched with 2 gms of 45% sodium hydroxide solution. The resulting mixture was filtered to remove insoluble salts containing spent catalyst and vacuum-stripped to remove light ends. A copolymer of tertrahydrofuran and long chain epoxide was prepared in 79.8% yield and analyzed to contain 20 percent tetrahydrofuran and 80% epoxyalkanes. The THF/long chain epoxide mole ratio in the copolymer was 3:5 as determined by NMR. Properties of the copolymer were Kv@100° C.=26 cSt, Kv@40° C.=198 cSt, VI=165, and pour point (PP) was <−24° C.

EXAMPLE 2

Following the procedure of Example 1, an ethylene glycol end-capped copolymer of tetrahydrofuran and 1,2-epoxyalkanes (epoxydecane, epoxydodecane, and epoxytetradecane in 1:1:1: weight ratio) with a THF/epoxy mole ratio of 3:5 was prepared in 75% yield. Properties of the copolymer were Kv@100° C.=24 cSt, Kv@40° C.=187 cSt, VI=150.

EXAMPLE 3

Following the procedure of Example 1, a low viscosity butanol end-capped copolymer of tetrahydrofuran and 1,2-epoxyalkanes (epoxydecane, epoxydodecane, and epoxytetradecane in 1:1:1: weight ratio) with a THF/epoxy mole ratio of 3:5 was prepared in 80% yield. Properties of the copolymer were Kv@100° C.=16 cSt, Kv@40° C.=112 cSt, VI=154.

EXAMPLE 4

Following the procedure of Example 1, a copolymer of tetrahydrofuran and 1,2-epoxyalkanes with a THF/epoxy mole ratio of 4:3 was prepared in 86% yield and analyzed by NMR. Properties of the copolymer were Kv@100° C.=9.2 cSt, Kv@40° C.=61 cSt, VI=144.

EXAMPLE 5

Following the procedure of Example 1, a copolymer of tetrahydrofuran and 1,2-epoxyalkanes with a THF/epoxy mole ratio of 3:1 was prepared in 95% yield. Properties of the copolymer were Kv@100° C.=24.4 cSt, Kv@40° C.=162 cSt, VI=184.

Referring to FIG. 1, a graft is presented showing the total solubility of the polyalkylene oxide copolymer of the invention (Example 1) as blended (wt %) into PAO having a viscosity of 100 cSt@100° C. and plotted against the blend viscosity (Kv@100° C.). The graft shows that proportions of the blends form homogeneous mixtures with high viscosity PAO.

Figure 2:
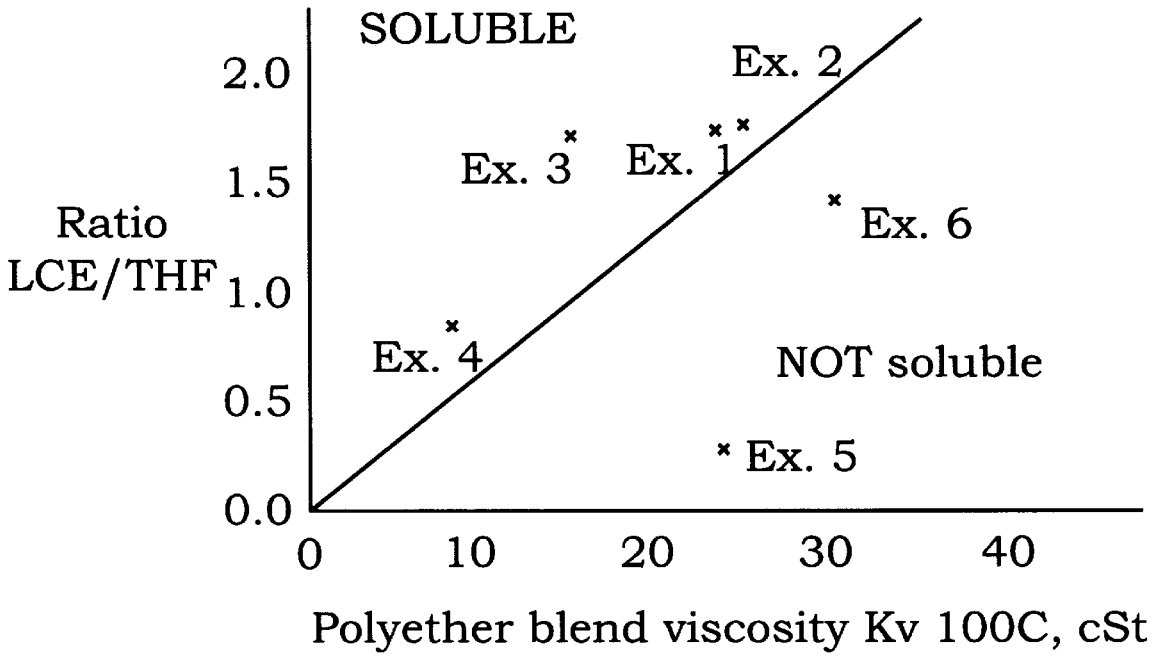
FIG. 2 is a graft illustrating the effect of mole ratio of long chain epoxides to THF versus polyalkylene oxide viscosity on the miscibility of polyethers of the invention in PAO.

FIG. 2 plots the mole ratio of long chain epoxide to THF in the polyalkylene oxide copolymers versus the copolymer viscosity. The plot illustrates the discovery that high ratios of LCE to THF promote solubility in PAO as does lower polyalkylene oxide copolymer viscosity.

The foregoing graphs illustrate the central discoveries of the invention, i.e., that polyethers can be dissolved in high viscosity PAO or other SHF when the polyalkyleneoxide polyether is produced from one or more long chain epoxides in combination with other cyclic ethers as comonomers that can produce linear or unbranched methylene recurring units. Accordingly, when polyether/high viscosity SHF blends of various compositions are required to optimize lube properties for various applications, the mole ratio of cyclic ether to long chain epoxide comonomers in the copolymer can be adjusted and/or the viscosity of the polyalkylene oxide copolymer produced can be altered to maintain solubility of the copolymer in high viscosity PAO.

The following Table 1 presents the results of miscibility studies with 100 cS PAO and Examples 1–5 polyethers as compared with commercial polyethers. Misibility studies were also carried out on Examples 1–4 polyethers with a 5.6 cSt PAO fluid. The fluids prepared in Examples 1–4 are all soluble in a lower viscosity PAO 5.6 cSt fluid. However, for comparison purposes, polyether fluids produced commercially from Dow (PB-100 and PB-200) which are soluble in a 100SUS mineral oil (Mobil stock 142, about 4 cSt at 100° C.) are not soluble in the 5.6 cSt PAO fluid. This compatibility study demonstrated that the Examples 1–4 fluids are different than or better than the fluids that are commercially available. The commercial polyether fluids are soluble in mineral oil but not in 5.6 cSt PAO. However, the polyether fluids of the invention are soluble in 5.6 cSt PAO, allowing greater formulation flexibility.

Miscibility studies were also carried out using a 4 cSt severely hydrocracked base stock. The polyethers of Examples 1–4 were found to be soluble in the severely hydrotreated base stock. However, the PB200 type polyether fluid from Dow Chemical Co. was not soluble in the 4 cSt severely hydrocracked basestock.

TABLE 1

| Fluid | THF/LC Epoxide mole ratio | Kv @ 100° C. cSt | solubility in 100 cSt PAO |
|---|---|---|---|
| Expl. 1 | 3:5 | 26 | soluble |
| Expl. 2 | 3:5 | 24 | soluble |
| Expl. 3 | 3:5 | 16 | soluble |
| Expl. 4 | 4:3 | 9.2 | soluble |
| Expl. 5 | 3:1 | 24 | not soluble |
| DOW[1] | N/A | 24 | not soluble |

[1]2,000 MW polybutylene oxide polyether from DOW.

The compatibility or solubility studies of the invention demonstrate that fluids of the invention are unique and have improved properties. They are soluble in the challenging PAO fluids of different viscosities from 4–100 cS and in severely hydrocracked basestocks having a viscosity of 3–50 cSt at 100° C. Other commercial polyethers, although they are soluble in mineral oil, are not soluble in PAO fluids of different viscosities or in severely hydrocracked basestock.

Table 2 presents antiwear (FBW) and low velocity friction (LVFA) tests

TABLE 2

| Fluid | Kv @ 100° C. | K factor (E10-8) | Wear Scar | Friction coef |
|---|---|---|---|---|
| Ex. 2 | 24 | 4.61 | 0.56 mm | |
| Syn. ester | 5.2 | 118 | 1.22 mm | 0.3263 (ave) |
| Ex. 4 | 9.2 | | | 0.2733 (ave) |

In Table 3, the antiwear test results from a study carried out on PAO and Example 3 polyalkylenoxide blends of the invention are presented.

TABLE 3

| Polyether % | FBW, wear scar, mm |
|---|---|
| 0 | 1.989 |
| 5 | 0.650 |
| 10 | 0.644 |
| 20 | 0.633 |
| 100 | 0.644 |

What is claimed is:

1. A liquid lubricant composition comprising:

a homogeneous blend of synthetic hydrocarbon fluid comprising polyalphaolefins(s) having a viscosity of 3–1000 cSt at 100 C. or severely hydroprocessed basestock and polyalkylene oxide polymer or copolymer having recurring oxyalkylene units of at least one long chain monoepoxy alkane monomer containing 8 to 30 carbon atoms, said polymer or copolymer having a viscosity of 5–200 cSt at 100 C. with said monomer (s) taken in combination with one or more short chain comonomer(s) selected from the group consisting of $C_1$–$C_4$ alkyl substituted or unsubstituted tetrahydropyran, tetrahydrofuran, oxetane, butylene oxide, propylene oxide and ethylene oxide, wherein the mole ratio of long chain monoepoxy alkane monomers to short chain comonomers is between 0.5 and 9.

2. The liquid lubricant composition of claim 1 wherein said polyalkylene oxide polymer has the following structure:

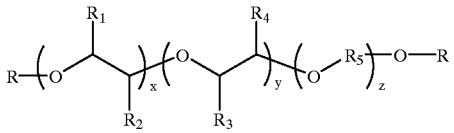

wherein R is hydrogen, alkyl, aryl or carbonyl; $R_1$ is hydrogen or $C_1$–$C_{27}$ alkyl and $R_2$ is $C_1$–$C_{28}$ alkyl with at least one of $R_1$ or $R_2$ having between 6 and 27 carbon atoms; $R_3$ and/or $R_4$ are hydrogen or methyl; $R_5$ is $C_1$–$C_4$ alkyl substituted or unsubstituted linear polymethylene including trimethylene, tetramethylene or pentamethylene; and x is an integer from 1 to 50 with recurring unit of x alike or different, and y and z are integers from 0 to 50.

3. The liquid lubricant of claim 1 wherein the mole ratio of said long chain monoepoxy alkane monomers to said short chain comonomers is between 1 and 3.

4. The liquid lubricant composition of claim 1 wherein said polyalkylene oxide polymer contains recurring units of at least three of said long chain monoepoxy alkane monomers.

5. The liquid lubricant composition of claim 1 wherein said comonomer comprises tetrahydrofuran and said long chain monoepoxy alkane monomers comprise equimolar ratios of epoxydecane, epoxydodecane and epoxytetradecane.

6. The liquid lubricant composition of claim 1 wherein said severely hydroprocessed basestock has a viscosity of 3–50 cSt at 100° C.

7. The liquid lubricant composition of claim 1 wherein said polyalkylene oxide polymer comprises the product of a process comprising:

contacting at least one long chain monoepoxy alkane monomer(s) containing 8 to 30 carbon atoms with heteropolyacid catalyst in a polymerization zone under polymerization conditions, said alkane monomer(s) contacted with one or more short chain comonomer(s) selected from the group consisting of substituted or unsubstituted tetrahydrofuran, oxetane, butylene oxide, propylene oxide and ethylene oxide; and recovering the polyether liquid lubricant product, wherein said heteropolyacid catalyst comprises mixed metal oxide heteropolyacids having the formula $H_xM_yO_z$ wherein H is hydrogen, M is metal selected from Group IA, IIA, IVA, IVB, VA, VB, VIA or VIB of the Periodic Table of the Elements, O is oxygen, x is an integer from 1 to 7, y is an integer of at least 1, and z is an integer from 1 to 60: wherein a mole of said catalyst contains between 0 and 30 moles of water of hydration.

* * * * *